US005406776A

United States Patent [19]

Cappi et al.

[11] Patent Number: 5,406,776

[45] Date of Patent: Apr. 18, 1995

[54] STRETCHER-INJECTOR DEVICE FOR AIRTIGHT SEALING AND GAS EXCHANGE IN MODIFIED ATMOSPHERE PACKAGES

[75] Inventors: Angelo Cappi, Vignola; Renato Rimondi, Bazzano, both of Italy

[73] Assignee: A.W.A.X. Progettazione E Ricerca S.r.l., Vignola, Italy

[21] Appl. No.: 189,824

[22] Filed: Feb. 1, 1994

[30] Foreign Application Priority Data

Feb. 16, 1993 [IT] Italy ..... MI93A0285

[51] Int. Cl.[6] ..... B65B 31/00

[52] U.S. Cl. ..... 53/510; 53/512; 53/373.6

[58] Field of Search ..... 53/512, 510, 372.5, 53/372.7, 372.6, 373.6, 375.6, 79, 88, 403, 402, 434

[56] References Cited

U.S. PATENT DOCUMENTS 5,201,165 4/1993 Marano et al. ..... 53/510
5,228,269 7/1993 San Filippo et al. ..... 53/510
5,271,207 12/1993 Epstein et al. ..... 53/510

*Primary Examiner*—John Sipos
*Assistant Examiner*—Gene Kim
*Attorney, Agent, or Firm*—Panitch Schwarze Jacobs & Nadel

[57] ABSTRACT

A stretcher-injector device to be applied to wrapping machines is disclosed, which is suitable to be inserted into each of the two lateral film sleeves resulting from the wrapping at the two opposite sides of the package not covered by the film wrapping; it is actuated pneumatically both to stretch the film in order to assure its airtightness, and to carry out the atmosphere change inside the package, e.g. of food products.

4 Claims, 3 Drawing Sheets

STRETCHER-INJECTOR DEVICE FOR AIRTIGHT SEALING AND GAS EXCHANGE IN MODIFIED ATMOSPHERE PACKAGES

The present invention concerns a stretcher-injector device to be applied to wrapping machines for the airtight sealing of wrapped packages, and for the gas exchange in modified atmosphere packages.

It is known that in preparing modified atmosphere packages, the so-called wrapping is carried out first, i.e. the circumferential wrapping of the package resulting in the formation of a film sleeve projecting from each of the two opposite package surfaces not wrapped by the film. Said sleeves are then subjected to sealing while simultaneously carrying out the gas exchange to obtain the modified atmosphere package.

It is also known that, the film used in wrapping being of the non-extensible kind, at said sleeves it tends to form folds and/or wrinkles which compromise the seal. In fact, for a good outcome of the sealing it is important that it is carried out without the presence of folds on the sealing line, since these cause Such thickness variations on said line that the sealing blades can not get into close contact with the film in the lower thickness points, thus creating there weakness areas caused by insufficient sealing.

The object of the present invention is to provide a device capable of stretching the film sleeve in each of the two side faces of the package, in order to prevent folds and/or wrinkles, so that the sealing blades come in contact with the perfectly stretched film, thus achieving a uniform bead without strength discontinuities.

Said device must also be capable of injecting inside the package the specific gas for the packaging of items in modified atmosphere.

This object is achieved by means of a stretcher-injector device having the characteristics specified in claim 1.

The stretcher-injector according to the present invention, once it is inserted and actuated inside each of the two film sleeves, offers the advantage of stretching said film sleeve, which fits tightly the stretcher contour, thus allowing a uniform and homogeneous sealing of the film.

A further advantage offered by the device according to the present invention is that during the step of air aspiration from the package, the film airtightly adheres to the periphery of the stretcher-injector thus allowing a quick and complete evacuation of the air from inside the package.

These and other advantages and characteristics of the stretcher-injector according to the present invention will be apparent to those skilled in the art from the following detailed description of a preferred embodiment thereof, referring to the annexed drawings wherein.

Figure 1:
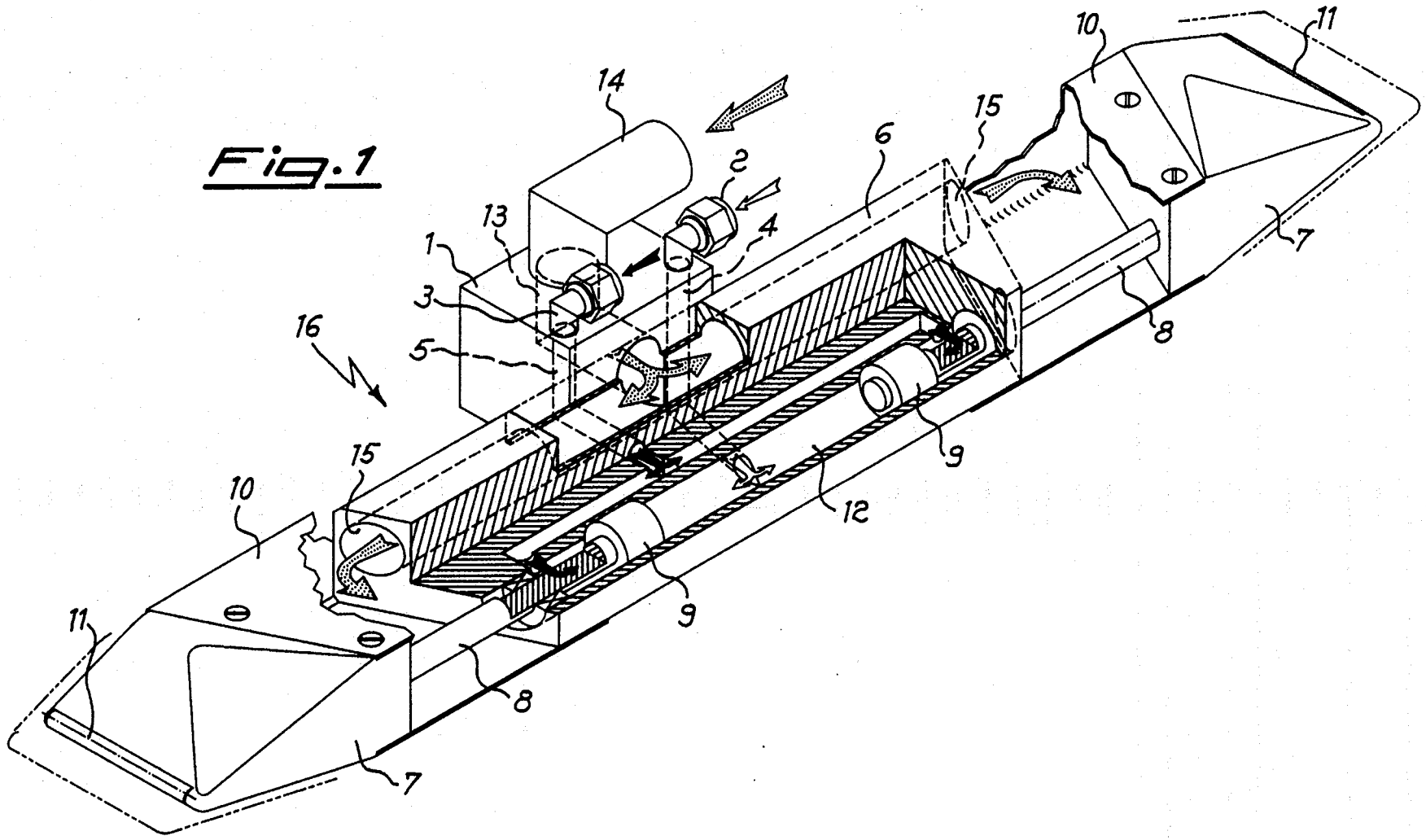
FIG. 1 shows a partially sectioned perspective view of the device subject-matter of the invention.

Referring to FIG. 1, there is seen that the stretcher-injector device according to the present invention includes a lateral body 1, approximately cube-shaped, provided with two fittings 2 and 3 to connect two ducts 4 and 5, respectively, to a pneumatic plant (not shown).

Said ducts 4 and 5 are partially contained within body 1 and partially within a central body 6 integral or fixed thereto and approximately parallelepipedal.

The mobile ends 7 of said body 6 are wedge-tapered and mounted on the stems 8 of two double-effect linear actuators 9, each of said ends 7 being provided with a cover 10 made of sheet metal, or other suitable material, which laterally covers body 6, but the side facing the package, and whose function will be explained later on.

The compressed air supplied by the pneumatic plant through ducts 4 and 5 is used for the opening and closing actuation, respectively, of said actuators 9 as it will be better explained further on.

Furthermore, one or more idle rollers 11, whose purpose will be made clear later on, are mounted on the edge of each of said ends 7.

A sliding seat 12 of actuators 9 arranged in a line is also inside central body 6, while a further duct 13 is partially inside said body 6 and partially in body 1, which is located around mid-length of said body 6 so that the two arms of ducts 5 and 13 directed towards the ends of body 6 have about the same length.

Said duct 13 is connected through a sleeve 14, or a similar connecting means mounted on body 1, to a pneumatic plant (not shown) which provides for the atmosphere exchange inside the package through the end apertures 15 of said duct 13.

Figure 2:
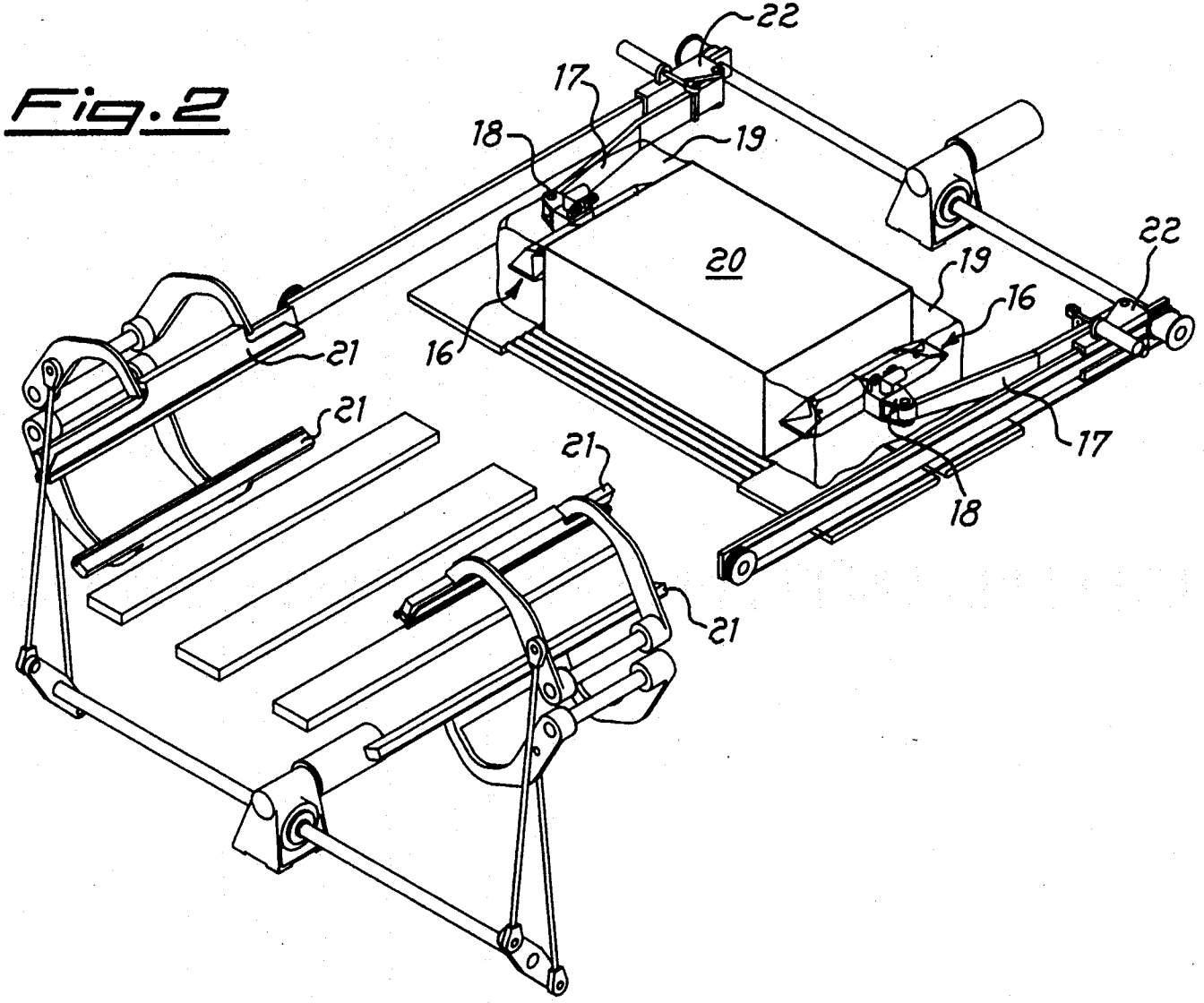
FIG. 2 shows a perspective view of a wrapping and sealing machine including a pair of said devices, in the starting step of the operative cycle.
Figure 3:
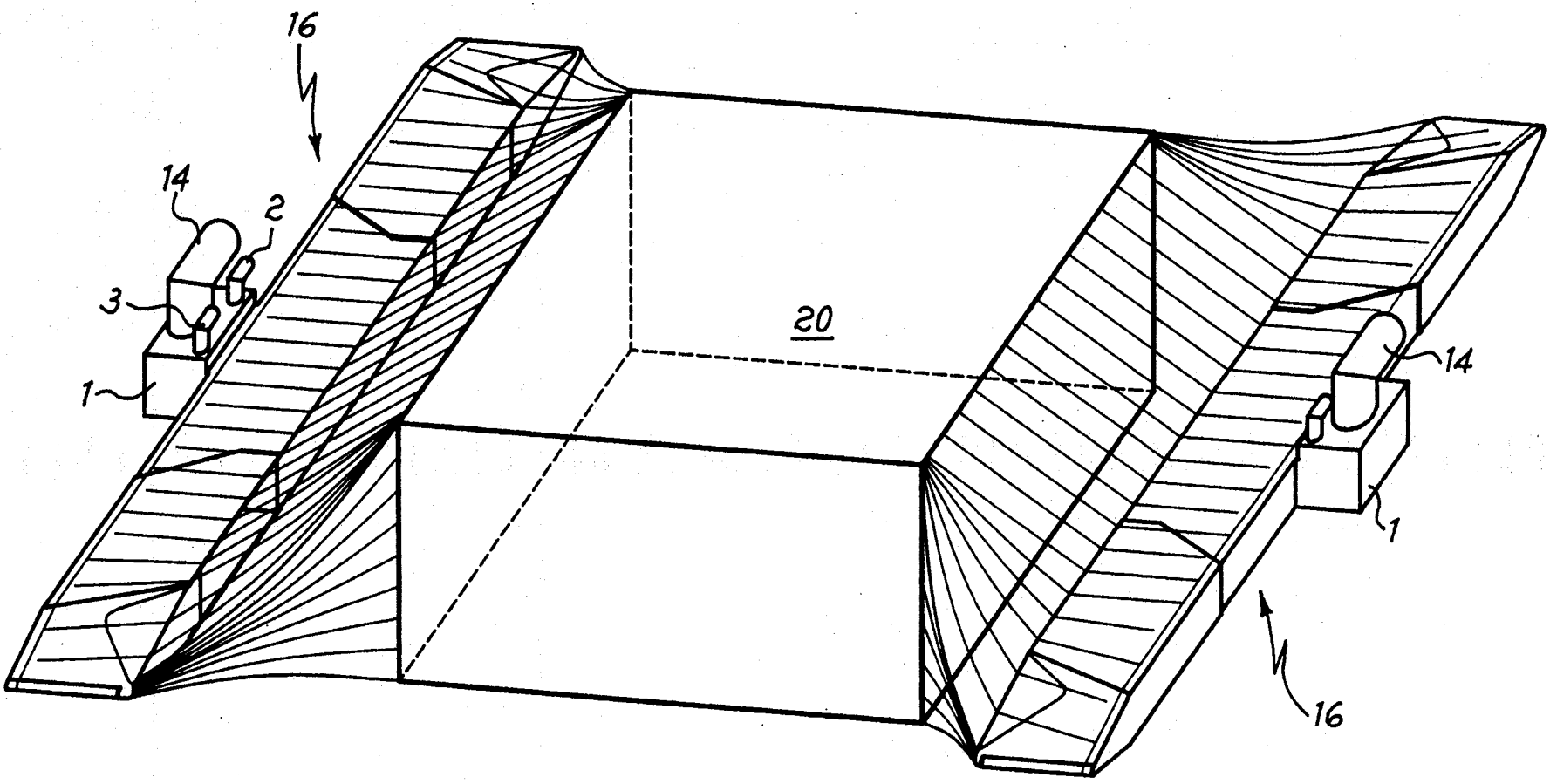
FIG. 3 shows a perspective view of a pair of devices according to the present invention in the completely open position.

Referring now to FIGS. 2 and 3 too, the working of a pair of stretcher-injector devices according to the present invention, each of them generally indicated by 16, is illustrated hereunder, when applied to a known wrapping and sealing machine.

Each of the devices 16 is mounted on a support arm 17 by means of a bracket 18, or other suitable connecting means, and is positioned by said arm 17, in the closed position of starting cycle, inside each of the two film sleeves 19 which were formed at the ends of package 20 following the wrapping operation.

Device 16 is positioned by the relevant supporting member 17 at such a distance from the package to be packed so as to allow the working of the sealing blades 21 at the subsequent sealing station.

Compressed air is supplied through fitting 2 into duct 4 which comes out in the middle of seat 12, as indicated by the white arrows in FIG. 1, in order to cause the opening actuation of actuators 9, which move away from each other and make ends 7 move away from central body 6, thereby also determining the opening of apertures 15.

During this opening motion of device 16, the idle rollers 11 mounted on the edge of ends 7 make the sliding of the film on said ends easier, so that the film sleeve widens and flattens assuming approximately a duck-beak configuration, as shown in FIG. 3, adhering to the periphery of device 16.

Covers 10 which cover the lateral sides of central body 6, but the one facing the package, carry out the double function of keeping ends 7 always perfectly aligned with said central body 6 during the opening and closing motion of the device, as well as of assuring the airtightness of the stretcher-injector during the subsequent step of the gas exchange inside the package, by closing the room between body 6 and ends 7.

Obviously, said covers 10 could carry out a better guiding function by covering body 6 on all lateral sides, in this case, however, there would be a greater motion friction and the side facing the package should be provided with passages to allow the gas exchange inside the package.

This exchange step takes place at the end of the opening stroke of actuators 9, when stretcher-injector 16 is in the open position of FIG. 3, and involves a first aspiration of the air inside the package by means of the pneumatic plant connected to sleeve 14; the air is evacuated through apertures 15 and duct 13, in a direction opposite to that indicated by the dotted arrows in FIG. 1, and it is then replaced by any suitable gas for modified atmosphere packages, as indicated by the dotted arrows.

A further advantage offered by the device according to the present invention is that during the evacuation step, the film webs forming sleeves 19 are perfectly stretched and adherent to the periphery of devices 16, in a completely open position, thus achieving a sufficient airtightness to effectively evacuate the air contained in the package.

Once the gas exchange has been carried out, sealing blades 21 provide for the sealing of the package, coming in contact with two webs of film perfectly stretched and without folds and/or wrinkles; in this way, a regular and uniform seal bead, without weakness points, is obtained according to the main object of the invention.

After the sealing of sleeves 19, the pneumatic plant to which fitting 3 is connected supplies compressed air into duct 5 whose arms come out at the ends of seat 12, as indicated by the black arrows in FIG. 1, for the closing actuation of actuators 9; in this way, it is caused the reverse working of said actuators, which move towards each other thus making ends 7 approach central body 6 and subsequently close apertures 15.

During the closing step, each stretcher-injector 16 is moved away, by means of the relevant support arm 17, from the sealed package 20, and it is ready to start a new operative cycle.

A possible variation to the above-described embodiment is to manufacture one of the two stretcher-injectors 16 of the pair without sleeve 14 and relevant duct 13, thus completely transferring to the other stretcher-injector of the pair the function of gas exchange. This would obviously involve a decrease in the effectiveness of the operative cycle for normally rather large packages, but it can prove advantageous when applying the device to small packages containing little air.

Another possible advantage of the application of these devices to a known wrapping and sealing machine is that of using the pair of stretcher-injectors 16 for moving package 20 from the wrapping to the sealing station.

In order to do so, it is sufficient that supporting members 17 are mounted in turn on moving means 22, and that the first two steps of the cycle (i.e. insertion into the sleeve and opening of the stretcher-injector) take place when package 20 to be sealed is still on the wrapping station; in this way, the two devices 16 would take package 20 with them in their motion towards the sealing station.

We claim:

1. A stretcher-injector device for the airtight sealing and gas exchange in modified atmosphere packages, characterized in that it consists in a central body (6) enclosing a pair of double-effect linear actuators (9) with stems (8) suitable to slide in a seat (12) having a middle communicating with a first duct (4) for the inflow of compressed air and two ends communicating with a second duct (5) for the inflow of compressed air, two mobile ends (7) fixed onto said stems (8) of said actuators (9) and provided with a cover (10) suitable to move over said central body (6) to close the room between the central body (6) and the mobile ends (7) on all sides of the device except the side facing the package, thereby leaving said facing side open, a third duct (13) located inside the central body (6) with apertures (15) that come out under cover (10) and communicate with the package through said open facing side and a lateral body (1) integral with the central body (6) and provided with fittings (2, 3) for connecting said ducts (4, 5) to a source of compressed air, and a sleeve (14) for connecting said third duct (13) to a source of product treating gas, said mobile end (7) being extended within the open end of the package to stretch the wrapping material and allow the gas treatment of the product through said third duct and whose apertures (15) come out under the cover (10).

2. A device according to claim 1, characterized in that at least one idle roller (11) is mounted on the edge of each end (7).

3. A device according to claim 1, characterized in that the cover (10) covers body (6) on all the lateral sides thereof and has passages for the gas exchange on the side facing the package.

4. A device according to claim 1, characterized in that body (1) is located at mid-length of body (6).

* * * * *